US009637875B2

(12) United States Patent
Losen et al.

(10) Patent No.: US 9,637,875 B2
(45) Date of Patent: May 2, 2017

(54) STRIPPING DEVICE COMPRISING A STRIPPING BAR FOR A GROUND MILLING MACHINE, STRIPPING ELEMENT FOR A STRIPPING BAR, AND GROUND MILLING MACHINE COMPRISING A STRIPPING DEVICE

(71) Applicant: BOMAG GmbH, Boppard (DE)

(72) Inventors: Fabian Losen, Bell (DE); Markus Schaefer, Braubach (DE); Steffen Wachsmann, Koblenz (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/295,928

(22) Filed: Jun. 4, 2014

(65) Prior Publication Data

US 2014/0361599 A1 Dec. 11, 2014

(30) Foreign Application Priority Data

Jun. 7, 2013 (DE) ..... 10 2013 009 611

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/127
USPC ..... 299/39.1, 39.2, 39.4, 39.6
See application file for complete search history.

(56) References Cited

U.S. PATENT DOCUMENTS 3,152,411 A * 10/1964 Wood ..... E02F 3/8152 172/701.3
4,501,079 A * 2/1985 Hahn ..... E02F 9/2841 172/701.3
5,396,963 A * 3/1995 Curry ..... E02F 3/8152 172/701.3

(Continued)

FOREIGN PATENT DOCUMENTS

DE 102 47 579 B3 4/2004
DE 20 2010 008 045 U1 1/2012

(Continued)

OTHER PUBLICATIONS

Espacenet, English Machine Translation of WO03029564A2, published Apr. 10, 2003, retrieved from http://worldwide.espacenet.com on May 27, 2014 (13 Pages).

(Continued)

*Primary Examiner* — David Bagnell
*Assistant Examiner* — Michael Goodwin
(74) *Attorney, Agent, or Firm* — Wood Herron & Evans LLP

(57) ABSTRACT

The present invention relates to a stripping device for a ground milling machine, comprising a stripping plate comprising a bottom plate edge and a stripping bar comprising at least one stripping element disposed on the bottom plate edge, wherein form-fitting elements are present on the at least one stripping element and on the stripping plate, which form-fitting elements at least partially interlock in complementary fashion and prevent displacement of the at least one stripping element. The present invention further relates to a stripping element for such a stripping device, and to a ground milling machine having such a stripping device.

17 Claims, 3 Drawing Sheets

(56) References Cited

U.S. PATENT DOCUMENTS

| | | | | |
|---|---|---|---|---|
| 5,474,397 | A * | 12/1995 | Lyons | E01C 23/088 299/39.5 |
| 6,923,508 | B2 * | 8/2005 | Holl | E01C 23/088 299/36.1 |
| 8,393,660 | B2 * | 3/2013 | Luyendijk | B66C 3/02 294/86.4 |
| 9,089,087 | B2 * | 7/2015 | Ley | A01B 76/00 |
| 2004/0075330 | A1 | 4/2004 | Holl et al. | |
| 2006/0026870 | A1 * | 2/2006 | Karhi | E01H 5/061 37/266 |
| 2011/0232927 | A1 * | 9/2011 | Tutschek | A01B 31/00 172/701.3 |
| 2013/0195554 | A1 * | 8/2013 | Rukavina | E01C 23/088 404/90 |

FOREIGN PATENT DOCUMENTS

| | | | |
|---|---|---|---|
| DE | 10 2012 012 607 | A1 | 1/2014 |
| DE | 10 2012 018 918 | A1 | 3/2014 |
| WO | 03/029564 | A2 | 4/2003 |

OTHER PUBLICATIONS

Espacenet, English Machine Translation of DE10247579B3, published Apr. 15, 2004, retrieved from http://worldwide.espacenet.com on May 27, 2014 (6 Pages).

Espacenet, English Machine Translation of DE202010008045U1, including English translation of Abstract, published Nov. 14, 2011, retrieved from http://worldwide.espacenet.com on May 27, 2014 (8 Pages).

Espacenet, English Machine Translation of DE102012012607A1, published Jan. 2, 2014, retrieved from http://worldwide.espacenet.com on May 27, 2014 (17 Pages).

German Patent Office, Search Report, Application No. 10 2013 009 611.1, dated Feb. 26, 2014 (5 Pages).

Espacenet, English Machine Translation of DE102012018918A1, published Mar. 27, 2014, retrieved from http://worldwide.espacenet.com on May 27, 2014 (9 Pages).

* cited by examiner

STRIPPING DEVICE COMPRISING A STRIPPING BAR FOR A GROUND MILLING MACHINE, STRIPPING ELEMENT FOR A STRIPPING BAR, AND GROUND MILLING MACHINE COMPRISING A STRIPPING DEVICE

CROSS-REFERENCE TO RELATED APPLICATIONS

The present application claims priority under 35 U.S.C. §119 of German Patent Application No. 10 2013 009 611.1, filed Jun. 7, 2013, the disclosure of which is hereby incorporated herein by reference in its entirety.

FIELD OF THE INVENTION

The present invention relates to a stripping device comprising a stripping bar for a ground milling machine, to a stripping element for such a stripping bar, and to a construction vehicle, more particularly, a ground milling machine, comprising such a stripping device.

BACKGROUND OF THE INVENTION

Generic construction vehicles, more particularly, ground milling machines such as road milling machines, recyclers, stabilizers, or surface miners, are frequently used in road and path construction. They comprise a machine frame, an operator's platform, a plurality of crawler tracks, and a drive engine, usually of the Diesel type. The key element of such a ground milling machine is a milling drum mounted for rotation within a milling drum box. This usually consists of a hollow cylinder, comprising a large number of chiseling devices on its outer cylindrical surface. During operation of the ground milling machine, the rotation of the milling drum causes this chiseling equipment to be driven into the ground so as to remove the ground material. The milled material is generally conveyed by a discharge conveyor, either in the direction of advance or contrary thereto, for transfer to a transport vehicle and dispatched. The rear surface of the milling drum box, as regarded in the direction of advance, is frequently constructed as a vertically adjustable stripping device comprising a stripping plate. Ground milling machines comprising such stripping devices are disclosed, for example, in DE 102012012607.7 and DE 102012018918.4.

During operation, the stripping plate of the stripping device is guided with its bottom plate edge either directly scraping the surface of the milled bed, or in a raised position just above it. It is the purpose of the stripping device to leave a clean milled bed behind the ground milling machine, leaving either no milled material or only a desired amount of milled material in the milled bed, as can be achieved by adjusting the height of the stripping device, which also makes it possible to adapt the latter to various milling depths. In particular, when no milled material is to remain in the milled bed and the stripping plate is thus in direct contact with the milled bed, particularly those regions of the stripping plate that touch the milled bed and the flanks of the milled groove will be subjected to a high degree of stress, resulting in rapid wear thereof. For this reason, the stripping device is usually equipped, in addition to the stripping plate, with an interchangeable stripping bar, which is disposed on the edges oriented toward the milled bed, more particularly, the bottom plate edge, of the stripping plate.

During operation, the stripping bar is in direct scraping contact with the milled bed and the flanks of the milled groove, so that the bottom plate edge of the stripping plate is not in direct contact with the milled bed and is thus protected from wear. The stripping bars are usually made of metal, for example, steel, and are equipped with carbide wear protection and made up of a number of individual stripping elements. The use of a number of individual elements makes it possible to replace only those individual elements which suffer greater wear due, for example, to cornering maneuvers or one-sided milling of edges, and thus to save costs. There are usually different stripping elements provided for different positions along the edge of the stripping plate, since it is known, on the one hand, which regions normally wear down more rapidly, and allowance is made, on the other hand, for optimization of the stripping elements for operation at their specific position (e.g., in the transition regions between horizontal and vertical edges).

The stripping elements are usually mounted onto the stripping plate via a suitable mounting device. Said mounting device may, for example, comprise through holes, screws or mounting bolts and fastening nuts. To this end, it is necessary to select the stripping element that is designated for the respective position on the stripping plate and to arrange this on the stripping plate in such a way that it can be mounted thereto via the mounting device, for example, by aligning the screw-threaded holes of the mounting device so as to lie coaxially against each other, so that a mounting screw can be inserted. For guidance, the assembler can only refer to the length of the different stripping elements and partially also elements of the mounting device such as the distance between the usually two screw-threaded holes required for the bolted connection. No other aid is provided to indicate where which stripping element is to be placed on the stripping plate. Additionally, depending on the specific design of the mounting device, slippage of the stripping elements might occur prior to or during the bolting operation, with the result that the screw threaded holes lose coaxial alignment, which would necessitate moving the stripping element back and forth until the desired position has been re-established. This can lead to the assembler having to reposition the individual stripping elements a number of times before the screw threaded holes regain coaxial alignment and assembly can be completed. In addition, the mounting device, and, if present, in particular, the bolted connections of the mounting device are usually required to absorb all forces exerted on the stripping elements and to transfer these to the stripping plate. High shearing forces, in particular, can lead to failure of the screws, resulting in the stripping bar not being able to function properly.

It is thus an object of the present invention to simplify the assembly of stripping elements on a ground milling machine's stripping device, and at the same time to provide improved force transmission from the stripping elements to the stripping plate.

SUMMARY OF THE INVENTION

More particularly, this is achieved by the use of a generic stripping device comprising a stripping bar comprising at least one stripping element disposed on the bottom plate edge of the stripping plate. In addition to elements of the mounting device, there are separate form-fitting elements present on this at least one stripping element as well as on the stripping plate, which interlock at least partially and which at least partially prevent slippage of the at least one stripping element on the stripping plate. Overall, there is thus a form fit between the at least one stripping element and the stripping plate. Whether these form-fitting elements are completely or only partly interlocked is of no significance, provided that slippage of the at least one stripping element is prevented at least partially. This interlock connection is preferably a mere form fit, whereas the force lock occurs by way of the mounting device, for example, via corresponding mounting screws, mounting bolts, etc. What is important is that the form fit device prevents slippage in at least one spatial direction and preferably in several spatial directions. The form fit thus provides for reliable pre-positioning of the stripping element on the stripping plate prior to any subsequent additional mounting via the mounting device. To this end, the form fit device is more preferably designed such that the form fit prevents movement in the vertical direction and the horizontal direction transverse to the working direction, relative to the working position of the stripping plate.

In the event of more than one stripping element being present, preferably each stripping element will have its own form-fitting elements adapted to interlock with the stripping plate. This "form fit" does not refer to the at least one stripping element bearing against the stripping plate, as is known in the art, nor does it refer to mounting of the at least one stripping element on the stripping plate by means of mounting screws. Instead, the present invention relates to an additional form-fitting connection that goes beyond any known force-fitting or form-fitting connection and exists between additional components disposed on the at least one stripping element and the stripping plate, which components are complementary to one another in a way that enables them to form a form-fitting connection. The form-fitting elements act to prevent the at least one stripping element from slipping relatively to the stripping plate.

One advantage of the present invention is that an assembler can interlock the form-fitting elements prior to mounting them by means of mounting screws so as to prevent slippage of the at least one stripping element during further assembly. A further advantage of the present invention is that the form-fitting elements transfer forces between the stripping bar and the stripping plate, thus relieving the mounting screws from, in particular, shearing forces.

In general, the form fit according to the present invention can prevent movement of the at least one stripping element relatively to the stripping plate in any direction, for example, transversely to the bottom plate edge of the stripping plate. It is particularly advantageous for the purpose of aiding the assembly of the at least one stripping element when the form-fitting elements are constructed so as to at least prevent slippage of the at least one stripping element along the bottom plate edge. Consequently, slippage in a direction parallel to the bottom plate edge, to the ground or to the axis of rotation is impossible. Since assembly is carried out on the bottom plate edge, an assembler can readily gage the distance between the stripping elements and the bottom plate edge, whilst in the prior art the position along the bottom plate edge is not unequivocally recognizable due to the fact that the stripping element extends only along part of this edge. The form fit simplifies positioning along the bottom plate edge.

The basic task of the mounting device is to hold the stripping element on the stripping plate. This can be achieved by a variety of different embodiments. For example, bolts, more particularly, screw-threaded bolts, can be attached to the stripping plate and/or on the respective stripping element, which bolts are guided through suitable through bores present in the respective counterpart, i.e., the stripping plate or the stripping element. Further, it is possible to use separate mounting screws, or mounting bolts, which are guided through suitable through bores present in both the stripping element and the stripping plate and secured by corresponding fastening nuts. The stripping device according to the present invention is especially useful in the case of mounting by use of mounting screws. In the case of through bores for mounting screws being present, particularly, in the stripping plate and the stripping elements, it is advantageous to have form-fitting elements formed such that an interlock of the form-fitting elements results in coaxial alignment of the through bores for the mounting screws. Thus, once the form-fitting elements interlock, the through bores for the mounting screws are aligned so as to form a continuous mounting channel into which the mounting screws can be inserted. This channel preferably extends through the at least one stripping element and the stripping plate. Once the interlock of the form-fitting elements has been established, in order to mount the at least one stripping element to the stripping plate, an assembler merely has to insert the mounting screws into the aligned through bores and fasten them.

A particularly simple method of positioning the at least one stripping element for insertion of the mounting screws is possible, when the form-fitting elements of the at least one stripping element are disposed between at least two through bores on the at least one stripping element. Stripping elements typically have at least two through bores for mounting screws, since the method of fastening with at least two screws is particularly stable. The arrangement of the form-fitting elements of the at least one stripping element in the region between these through bores may be located on all sides of the stripping element in said region. For example, the form-fitting elements may be disposed on that side with which the stripping element bears against the stripping plate in the mounted state, or on a side adjacent thereto. A possible, but less preferred, arrangement might also be for the form-fitting elements to be disposed in the mounted state on that side of the at least one stripping element that faces away from the stripping plate. It is also conceivable for the form-fitting elements to be positioned on the edge between two sides of the stripping element. What is important is that the form-fitting elements be positioned in that region that is delimited by at least two through bores. Such an arrangement is particularly suitable for the transmission of forces between the stripping element and the stripping plate and hence particularly stable.

It is further helpful when the stripping plate has a mounting recess for accommodation of the at least one stripping element so as to improve force transmission. It is preferable in this regard for the form-fitting elements to be disposed in the mounting recess. The mounting recess provides a step in the stripping plate, which step serves as a means of attachment for the at least one stripping element. Thus, the mounting recess is substantially a thinner portion of the stripper plate, located near the lower edge of the plate. This thinner portion corresponds to an abutment tongue forming an extension of the stripper plate. The transition to the normal-sized region of the stripping plate is formed by a step or knee, on which the at least one stripping element can be mounted. Due to the mounting on the step, forces can be transferred from the stripping element to the stripping plate in a particularly effective manner.

To prevent wedging or other malfunctions due to the vertical adjustment of the stripping device or deposition of milled material, the at least one stripping element is accommodated in the mounting recess so as to be flush with the stripping plate. No part protrudes from the mounting recess beyond the normal-sized region of the stripping plate. The stripping element as well as the mounting screws and the form-fitting elements are accommodated so as to be fully flush with the mounting recess. An assembler can also see that the form-fit between all parts has been accomplished without any errors by inspecting the flush contact. If the form-fitting elements are not brought to a proper interlock, a flush accommodation of the stripping element in the mounting recess is not possible.

In this embodiment, the form-fitting elements may also be disposed on all sides of the at least one stripping element that are adjacent to the stripping plate. In order that an assembler can see the form-fitting elements during the process of mounting the stripping element on the stripping plate in the best possible way, it is preferred that the at least one stripping element has an upper surface and the mounting recess forms a contact surface, and the form-fitting engagement of the form-fitting elements takes place between the contact surface of the stripping plate and the upper surface of the at least one stripping element. The contact surface of the stripping plate forms the step between the abutment tongue of the mounting recess and the normal-sized region of the stripping plate. The upper surface of the stripping element is that surface that rests against the contact surface of the stripping plate. Both the contact surface and the upper surface are equipped with form-fitting elements that interlock.

Different stripping elements are provided for different regions within the stripping bar due to different degrees of stress. To prevent the stripping elements from being mounted on the wrong position of the stripping plate, provision is made, when a plurality of stripping elements are present, for different pairs of complementary form-fitting elements to be provided on the stripping element and the stripping plate. As a result, different stripping elements will be assigned to certain designated positions on the stripping plate. In particular, the form-fitting elements of different pairs can differ in number and/or in design and/or in spacing from each other. In other words, stripping elements that are optimized for a certain position have form-fitting elements that are complementary only to such form-fitting elements on the stripping plate which are located on positions on which exactly this type of stripping element is required. A stripping element for the center of the stripping bar can therefore only be mounted at the center of the stripping bar, since at other positions the form-fitting elements are not designed in a complementary manner, so that mounting thereof is blocked. A stripping element for a corner of the stripping bar can only be installed at a corner and so forth. Pairs of complementary form-fitting elements therefore refer to coordinated units of the form-fitting elements on the stripping elements and on the stripping plate, which can interlock in a form-fitting manner. The differences between the pairs can be arbitrary, it being merely important to ensure that the mounting of a stripping element at a position that is not intended for said stripping element is prevented. Therefore, the different pairs can have different numbers of form-fitting elements, for example, one, two, or three, etc. Alternatively the form-fitting elements may be shaped differently. For example, they can be tongues, fingers, noses, teeth, dovetailed or of an entirely different shape. Another method for differentiation between the pairs may reside in spacing the form-fitting elements at different distances from each other. The respective embodiments allow for engagement with only the exactly complementary form-fitting elements on the stripping plate. Due to this allocation, installation at a false position is absolutely impossible.

For example, due to the assignment of stripping elements to their respective intended position on the stripping plate, a stripping element is, on account of the pairing of the form-fitting elements, assigned to a corner of the bottom plate edge of the stripping plate. Advantageously, the stripping element is equipped with a scraper bar at both end faces, which scraper bar is disposed at right angles to the bottom plate edge of the stripping plate. In addition, the stripping element comprises a scraper bar parallel to the bottom plate edge of the stripping plate. Due to the arrangement of the scraper bars one at each of the two opposite end faces of the stripping element the stripping element can be used at both corners of the bottom plate edge of the plate, where it comes into contact with both of the side surfaces of the milled groove as well as the milled bed via the scraper bars. Provision is therefore made for the form-fitting elements of the stripping element to be complementary to the form-fitting elements of the stripping plate which are located at the corners of the bottom plate edge of the stripping plate. The stripping element can thus be installed, for example, at two different positions of the stripping plate, namely those located in the corners.

In the case of a stripping element which is intended for use at the corners of the bottom plate edge of the stripping plate and which therefore includes scraper bars at right angles to the bottom plate edge of the stripping plate at its end faces, it is particularly advantageous when all of the form-fitting elements of the at least one stripping element are spaced apart from the side faces of the stripping element. The form-fitting elements are disposed, for example, in the central two-thirds of the length of the stripping element. Due to the fact that the form-fitting elements, which may be recesses for example, are disposed in the central region of the longitudinal extension of the stripping element, the stability of the stripping element in the region of the end faces is not reduced. This is of importance specifically when scraper bars are mounted on the end faces and at right angles to the bottom plate edge, which interact with the side surfaces of the milling bed and move toward the same in a scraping manner, since this imposes great forces on the scraper bars on the end faces. Positioning of the form-fitting elements away from the end faces prevents the latter from losing stability.

The form-fitting elements can generally have any shape that allows for at least partial form-fitting engagement of the complementary elements. They can, for example, be finger-shaped, nose-shaped, tongue-shaped or wave-shaped. Preferred are form-fitting elements that are tooth-shaped, because this shape makes for a very accurate form fit. It is advantageous when the form-fitting elements have a self-centering shape, so that the assembler does not have to align the at least one stripping element precisely with the form-fitting elements. Self-centering form-fitting elements are often designed with a cone shape, at least partially, and are characterized by the fact that they can slide along each other until they reach the final form-fit. Thus, due to the shape of the form-fitting elements, exact positioning of the at least one stripping element on the stripping plate is possible even in case of inaccurate positioning.

To increase the stability of the stripping bar even more, provision is made for at least two of the stripping elements to be positioned adjacently to each other and to have additional form-fitting elements on their adjoining faces, which at least partially interconnect with each other. These form-fitting elements thus do not create a form fit between the stripping element and the stripping plate, but between at least two adjoining stripping elements. A plurality of stripping elements form a chain, due to the form fit between the form-fitting elements, which chain is formed by interconnect of the adjoining end faces. This essentially prevents a movement, or rather a displacement, of the stripping elements perpendicularly to the bottom plate edge. Thus, forces acting on an individual stripping element can be transferred to a plurality of stripping elements, which results in load relief of the individual stripping elements.

The object of the present invention is further achieved by means of a stripping element for a stripping bar of a stripping device according to the above description and a ground milling machine, in particular, a road milling machine, a recycler, a stabilizer, or a surface miner equipped with a stripping device according to the above description.

BRIEF DESCRIPTION OF THE DRAWINGS

The present invention is explained in detail below with reference to exemplary embodiments shown in the figures, in which.

Like or functionally identical components are identified by the same reference numerals. Repeat components are not individually denoted in the different figures.

DETAILED DESCRIPTION OF THE INVENTION

Figure 1:
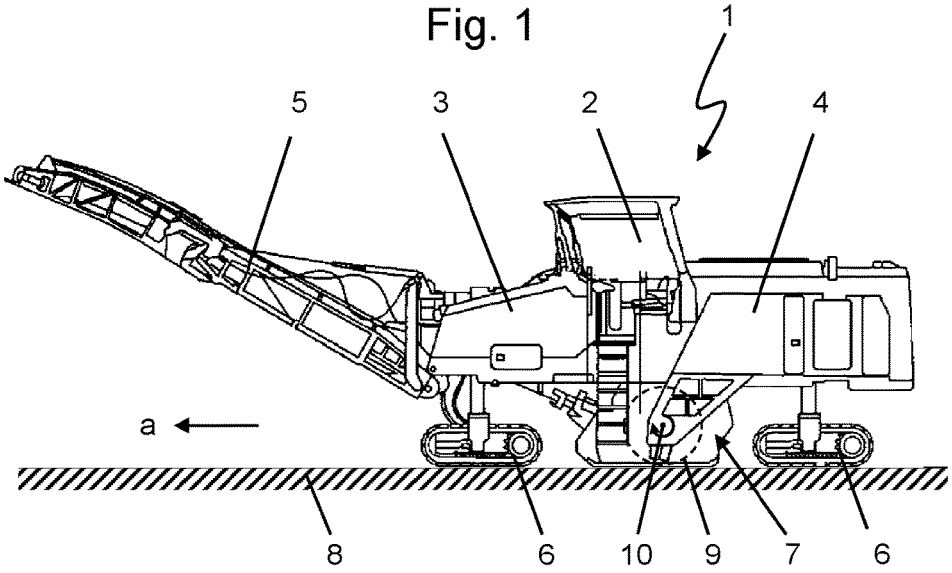
FIG. 1 is a diagrammatic side view of a generic ground milling machine.

FIG. 1 shows a generic ground milling machine 1, in this case a road milling machine or cold milling machine equipped with a central drum. It comprises a machine frame 3, an operator's platform 2, a drive engine 4 and crawler tracks 6. By means of a milling drum 9 mounted in the milling drum box 7 for rotation about the axis of rotation 10, the ground milling machine 1 mills, in operational mode, the ground 8, which is depleted in the direction of advance "a". By way of the discharge conveyor 5, the milled material is transferred to a transport vehicle (not shown) and dispatched.

Figure 2:
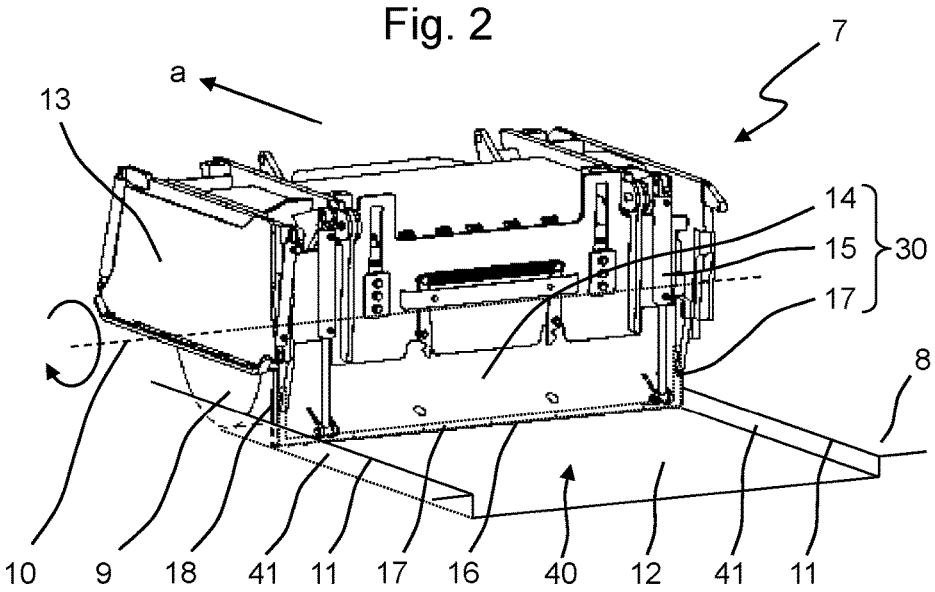
FIG. 2 is a diagrammatic perspective view of a milling drum box taken obliquely from the rear.

The structure and function of the milling drum box 7 is illustrated in FIG. 2. The milling drum box 7 is delimited at the sides by the side plates 13, which are intersected by the axis of rotation 10 of the milling drum 9. The side at the rear, as regarded in the direction of advance "a", is essentially formed by a stripping device 30, which comprises a stripping plate 14, a height adjustment device 15, in this case a hydraulic cylinder, and a stripping bar 17. During operation of the ground milling machine 1, the ground 8 is broken down due to the rotation of the milling drum 9 by means of the chiseling equipment disposed thereon (not shown), and the loosened milled material is removed via the discharge conveyor 5. A milled groove 40 is formed in the ground 8 and comprises milled edges 11, flanks 41 and a milled bed 12. The depth of the milled bed 12 depends on the set milling depth of the ground milling machine 1. The stripping device 30 can be adjusted to the milling depth by means of the height adjustment device 15. The stripping plate 14 is made either to directly scrape the surface of the milled bed 12 or to move just above the milled bed 12. In the first case, no or virtually no milled material remains in the milled bed 12, while in the second case, a desired amount of milled material is left in the milled bed 12. In particular, when the stripping plate 14 is caused to directly scrape the milled bed 12, there will be enormous abrasive stress on the bottom plate edge 16. In order to protect the stripping plate 14 from rapid wear, a stripping bar 17 is disposed both in the region of the bottom plate edge 16 that scrapes the milled bed 12 and on those sides of the stripping plate 14 that are disposed transversely to the direction of advance "a" and that come into contact with the milled edges 11 that project above the milled bed 12 and with the flanks 41. The stripping bar 17 is located on the front side of the stripping plate 14, as regarded in the direction of advance "a". In other words, the stripping bar 17 is located on that side of the stripping device 30 that faces the interior of the milling drum box 7 and that thus faces the milling drum 9. Therefore, in the scraping mode of the stripping device 30, the milled edges 11, the milled bed 12, and the flanks 41 of the milled groove 40 are first to come into contact with the stripping bar 17, which protects the bottom plate edge 16 of the stripping plate 14.

Figure 5:
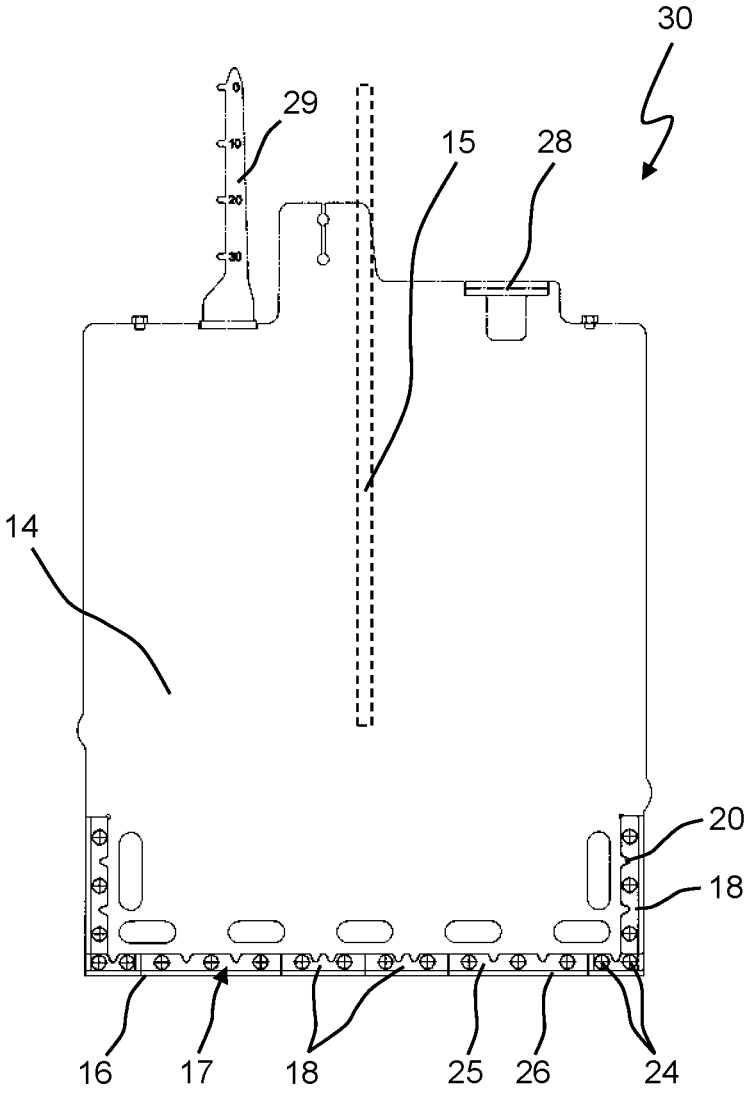
FIG. 5 shows a stripping device comprising a stripping bar, as viewed from the interior of the milling drum box.

The arrangement of the stripping bar 17 on the stripping device 30 is also shown in FIG. 5. In contrast to FIGS. 1 and 2, however, the stripping device 30 shown here is not that of a central rotor milling machine, but that of a rear rotor milling machine, often called a small milling machine. Due to the circumstances surrounding a milling machine of the rear rotor type, the stripping device 30 as shown in FIG. 5 exhibits a safety recess 28 for a safety hook (not shown) and a vertical adjustment display 29. The arrangement of the stripping bar 17 corresponds, however, to the embodiment shown in FIGS. 1 and 2. FIG. 5 shows the stripping device 30 as regarded from the interior of the milling drum box 7 contrary to the direction of advance "a". The stripping bar 17 extends over the entire bottom edge 16 of the stripping plate 14 and vertically upwardly to the side edges of the stripping plate 14 that extend transversely to the direction of advance "a". Basically, the stripping bar 17 could be made in one piece. In the embodiment shown, however, it is composed of a plurality of different stripping elements 18. The stripping elements 18 are disposed side by side along the bottom plate edge 16 of the stripping plate 14 in such a manner that a continuous stripping bar 17 is formed. At the corners of the stripping plate 14, which are oriented toward the milled bed and to the flanks 41, there are vertically disposed further stripping elements 18 for the purpose of covering and protecting from wear that edge of the stripping plate 14 that is disposed transversely to the direction of advance "a". Making the stripping bar 17 from individual stripping elements 18 can cut costs in that only single, worn-down stripping elements 18 need to be replaced.

FIGS. 3 and 4*a* to 4*d* show the construction of the stripping elements 18 and the way they are mounted on the stripping plate 14. Each stripping element 18 comprises a base body 25 made of metal, for example, steel, and has a length 36, a width 37, and a height 38. Furthermore, the stripping elements 18, when mounted, comprise a front surface 31, as regarded in the direction of advance "a", a rear surface 39 located opposite to the front surface 31, as regarded in the direction of advance "a", a scraper surface 35 oriented vertically downwardly toward the milled bed 12, and an upper surface 27, facing away from the scraper surface 35 in an upward direction. The edge between the front surface 31 and the scraper surface 35 is formed by a carbide scraper bar 26 that serves to reduce wear on the stripping elements 18.

Figure 3:
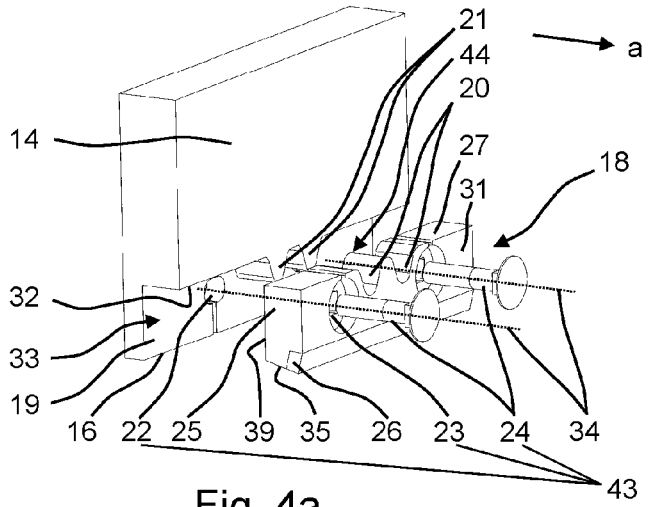
FIG. 3 is a diagrammatic perspective view of a portion of a stripping device and a stripping element.

Furthermore, the stripping elements 18 each comprise, as part of a mounting device 43, at least two through bores 23 for the insertion of mounting screws 24. The mounting screws 24 are inserted along the bolt axis 34 and into the through bores 22 in the stripping plate 14, as indicated in FIG. 3, and fastened by means of screw threads in the through bores 22, 23, and/or by nuts. According to this embodiment, the mounting device 43 thus comprises the through bores 22 and 23, the mounting screws 24, as well as nuts or screw threads for fastening the mounting screws. Possible alternatives here are bolts or other comparable means, which are arranged on the stripping elements or on the stripping plate. In the exemplary embodiment illustrated, the mounting screws 24 are preferably cup head square neck screws fastened by means of nuts, where twisting within the through bores 22 and 23 is prevented by means of the square neck and the complementary square hole 23. The stripping plate 14 comprises a mounting recess 33 that forms an abutment tongue 19 that is oriented toward the bottom plate edge 16, set at right angles to the direction of advance "a" and vertically downwardly toward the ground 8. Furthermore, the mounting recess 33 forms the contact face 32 of the stripping plate 14, set transversely to the abutment tongue 19 in a horizontal direction. The mounting recess 33 is designed for accommodating the stripping elements 18. Thus, when mounted, the stripping element 18 rests with its rear surface 39 against the front side of the abutment tongue 19, as regarded in the direction of advance "a", and also rests with its upper surface 27 against the contact face 32 of the mounting recess 33. The mounting recess 33 and the width 37 of the stripping element 18 are dimensioned such that the front surface 31 of the stripping element 18 is flush with the stripping plate 14. Furthermore, the mounting screws 24 are inserted in the through bores 23 in such a way that their heads are flush with the front surface 31 of the stripping element 18. No part protrudes beyond the mounting recess 33.

For the purpose of facilitating the assembly of the stripping bar 17, the stripping elements 18 have, as part of a form fit device, form-fitting elements 20, and the stripping plate 14 has complementary form-fitting elements 21 that by mutual interlocking prevent horizontal movement of the stripping elements 18 transversely to the bolt axis 34 of the mounting screws 24. More particularly, the exemplary embodiment illustrated shows tooth-like, finger-like, or nose-like protrusions on the contact face 32 of the mounting recess 33, and complementarily shaped recesses on the upper surface 27 of the stripping elements 18. The exact shape and arrangement of the form-fitting elements 20 and 21 along the stripping elements 18 and the stripping plate 14 is of no significance, provided that form-fitting interlocking of the form-fitting elements 20 and 21 is enabled, so as to prevent movement of the stripping elements 18 relatively to the stripping plate 14 and transversely to the bolt axis 34, or, more specifically, along the bottom plate edge 16. For the purposes of mounting a stripping element 18 to the stripping plate 14, an assembler thus merely has to arrange the stripping element 18 in such way as to cause the form-fitting elements 20 and 21 to interlock and then to insert the mounting screws 24 into the through bores 22 and 23 and to tighten them. Due to the form fit of the form-fitting elements 20 and 21, there is, on the one hand, no tedious moving back and forth of the stripping elements 18 toward the bottom plate edge to achieve coaxial alignment of the through bores 22 and 23, nor is there any possibility of the stripping element 18 slipping during the screwing operation. This, thus, results in quicker attachment of the stripping elements 18 and consequently of the stripping bar 17 to the stripping plate 14. Assembly is further facilitated on account of the shape of the form-fitting elements 20 and 21, by which means self-centering thereof is achieved. That is to say, even when the form-fitting elements 20 and 21 are lined up inaccurately, they will slide into the prescribed form-fitting interlocking position. Form fit can thus be achieved quickly and easily by the assembler, without there being any need to precisely and laboriously align the stripping elements 18.

As is visible in FIG. 5, the stripping bar 17 is composed of, or more particularly, is assembled from a plurality of different types of stripping elements 18. It has been found that the stripping bar 17 is subjected to varying degrees of stress at various points along the stripping plate 14 and thus wears down at varying rates. For the purpose of cutting costs on spare parts, the stripping bars 17 consist of stripping elements 18 that can be replaced independently of each other. The stripping elements 18, depending on where they are to be mounted on the stripping plate 14, are of different designs, for example, of different lengths. These different lengths 36 of the stripping elements 18 are chosen such that regions subjected to particularly high degrees of stress are provided with small stripping elements 18, as these require frequent replacement. Regions subjected to less stress can be provided with longer stripping elements 18 requiring less frequent replacement.

The varying lengths 36 of the stripping elements 18 and the respective position thereof in the stripping bar 17 provide means for optimizing the stripping elements 18 with respect to their individual position and their particular stress circumstances. FIGS. 4*a* to 4*d* each show a side view and a front view of the front surface 31 of different stripping elements 18, optimized for a particular position in the stripping bar 17.

Figure 4A:
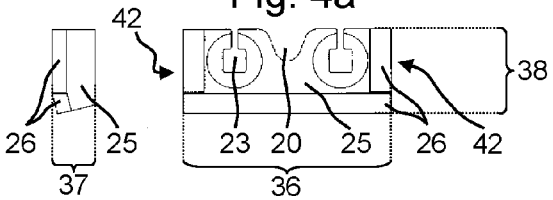
FIGS. 4*a* to 4*d* show various embodiments of stripping elements as front and side views.

FIG. 4*a* shows a relatively short stripping element 18, provided, in particular, for a corner oriented toward the milled bed 12 at those sides of the stripping plate 14 that extend transversely to the direction of advance "a". Unlike the other stripping elements 18, it therefore comprises, in addition to the scraper bar 26 along the edge between the front surface 31 and the scraper surface 35, two further scraper bars 26, each disposed at the end faces 42 and at right angles to the scraper surface 35. The form-fitting element 20 in the form of a tooth-like, finger-like or nose-like recess is disposed at a distance from the end faces 42. More particularly, it is disposed within the central two-thirds of the length 36 between the two through bores 23 for the mounting screws 24, and explicitly not where the two vertical scraper bars 26 are disposed. To simplify the assembly of the stripping element 18 as far as possible, the stripping element 18 comprises a vertical scraper bar 26 at each of the two end faces 42. As a result, the stripping element 18 can be mounted on either of the two corners of the stripping bar 17 without the assembler having to pay particular attention as to whether the additional scraper bar 26 has to be disposed on the left hand side or on the right hand side of the stripping element 18.

Figure 4B:
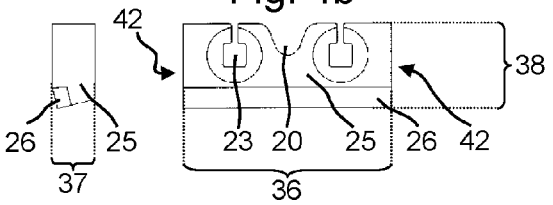

The stripping element 18 as shown in FIG. 4*b* is similar to that shown in FIG. 4*a* but omitting the scraper bars 26 disposed vertically and at right angles to the scraper surface 35. This stripping element 18 is, thus, not intended for the corners of the stripping bar 17, but for a position at which other stripping elements 18 are adjacently disposed along the bottom plate edge 16 so as to extend the length 36.

Figure 4C:
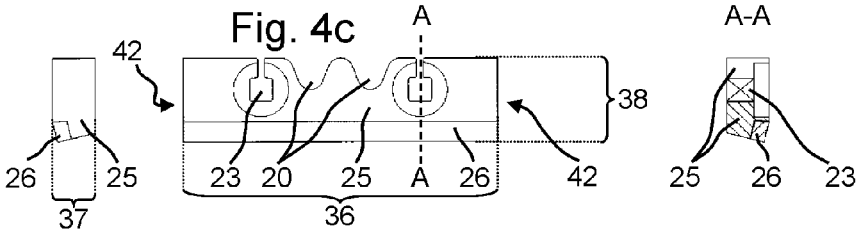

FIG. 4*c* shows a further embodiment of a stripping element 18. This stripping element 18 has a longer length 36 than the two stripping elements 18 as shown in FIGS. 4*a* and 4*b*. Furthermore, it comprises not just one form-fitting element 20, but two. Thus, there are provided two recesses, into each of which a protrusion serving as form-fitting element 21 on the stripping plate 14 can fit precisely. To simplify assembly, the two recesses are disposed at a distance from the end faces 42 in the central two-thirds of the length 36 of the stripping element 18, and are disposed adjacently to each other between the two through bores 23 for the mounting screws 24. Furthermore, FIG. 4*c* shows a cross section of the stripping element 18 taken along the dashed line A-A.

Figure 4D:
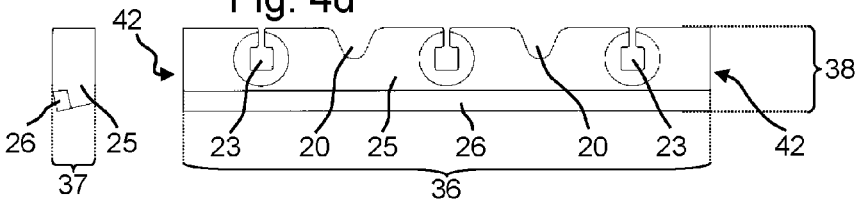

FIG. 4*d* shows a stripping element 18 having a length 36 greater than the lengths described above. Due to this greater length there are provided, in all, three through bores 23 for the mounting screws 24, which holes are distributed over the length 36. The two spaces between the three through bores 23 each comprise a form-fitting element 20 in the form of a recess. These recesses are spaced further apart than, for example, the two form-fitting elements 20 of the stripping element 18 as shown in FIG. 4*c*, for which reason the stripping element 18 as shown in FIG. 4*d* requires a different arrangement of the complementary form-fitting elements 21 pertaining to the stripping plate 14.

Each of the stripping elements 18 requires complementary form-fitting elements 21 pertaining to the stripping plate and adapted to coordinate with the form-fitting elements 20 pertaining to the stripping elements 18. To this end, the stripping elements 18 are form-coded in relation to the stripping plate 14. Due to the different lengths 36 of the stripping elements 18 and the varying number of form-fitting elements 20, or the varying distances between them, the stripping elements 18 can only be mounted at those positions of the stripping bar 17 at which the stripping plate 14 comprises relevant complementary form-fitting elements 21. Thus, with each position on the stripping plate 14 there can be associated a specifically adapted stripping element 18. The stripping bar thus comprises at least two stripping elements, the form-fitting elements of their respective form-fit device being implemented in a different manner in each case. Of course, there may be a number of positions at which a stripping element 18 can be disposed. This occurs whenever there is a plurality of positions in the stripping bar 17 at which like stresses occur such that like stripping elements 18 can be used. For example, FIG. 5 shows a stripping bar 17 composed of eight stripping elements 18, that is to say, four pairs of like stripping elements 18 per pair. Such form-coding facilitates assembly, since, on the one hand, the assembler can see from the form-fitting elements which stripping element 18 is associated with which position on the stripping plate 14, and, on the other hand, it prevents mounting of a stripping element 18 in the wrong position on the stripping bar, which would eventually lead to increased costs due to the wear on a possibly unnecessarily long, and thus expensive, stripping element 18.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A stripping device for a ground milling machine, comprising:

a stripping plate having a bottom plate edge; and a stripping bar comprising at least one stripping element disposed on the bottom plate edge, the at least one stripping element being releasably mounted on the stripping plate by use of a mounting device, wherein in addition to the mounting device, a separate form-fit device is integrally formed on the at least one stripping element and also integrally formed on the stripping plate, said form-fit device comprising form-fitting elements on the stripping element and on the stripping plate, which form-fitting elements at least partially interlock in complementary fashion and prevent displacement of the at least one stripping element.

2. The stripping device according to claim 1, wherein said form-fitting elements are shaped such that displacement of the at least one stripping element along the bottom plate edge is prevented.

3. The stripping device according to claim 1, wherein the mounting device comprises through bores for mounting screws, and the form-fitting elements are shaped such that the interlock of said form-fitting elements causes the through bores for the mounting screws to be oriented coaxially in relation to each other.

4. The stripping device according to claim 3, wherein the form-fitting elements are disposed between at least two through bores in the at least one stripping element.

5. The stripping device according to claim 1, wherein the stripping plate comprises a mounting recess for the accommodation of said at least one stripping element, and the form-fitting elements are disposed in the mounting recess.

6. The stripping device according to claim 5, wherein the at least one stripping element is accommodated flush with the stripping plate in the mounting recess.

7. The stripping device according to claim 5, wherein the at least one stripping element comprises an upper surface and the mounting recess forms a contact face, wherein the form-fitting interlock of the form-fitting elements takes place between the contact face of the stripping plate and the upper surface of the at least one stripping element.

8. The stripping device according to claim 1, wherein a plurality of different stripping elements is present, and for different positions along said stripping plate, different pairs of complementary form-fitting elements are provided on the stripping elements and on the stripping plate such that different stripping elements are assigned to given positions on said stripping plate.

9. The stripping device according to claim 8, wherein the form-fitting elements of the different pairs differ from each other in number and/or in design and/or in their distances from each other.

10. The stripping device according to claim 8, wherein a stripping element, due to the pairing of the form-fitting elements, is assigned to a corner of the bottom plate edge of the stripping plate, and the stripping element comprises at both end faces a scraping bar disposed at right angles to the bottom plate edge.

11. The stripping device according to claim 1, wherein all of the form-fitting elements of the at least one stripping element are set at a distance from end faces of the at least one stripping element.

12. The stripping device according to claim 1, wherein the form-fitting elements are tooth-shaped.

13. The stripping device according to claim 1, wherein the form-fitting elements have a self-centering shape.

14. The stripping device according to claim 1, wherein at least two stripping elements are present that are directly adjacent to each other and comprise additional form-fitting elements on end faces of the at least two stripping elements bearing against each other, which form-fitting elements at least partially interlock with each other.

15. A stripping element for a stripping bar of a stripping device according to claim 1.

16. A ground milling machine, comprising a stripping device according to claim 1.

17. The ground milling machine according to claim 16, wherein the ground milling machine comprises one of a road milling machine, a recycler, a stabilizer or a surface miner.

* * * * *